US010563416B1

(12) United States Patent
Vaghi

(10) Patent No.: US 10,563,416 B1
(45) **Date of Patent: *Feb. 18, 2020**

(54) COMBINATION PARKING STRUCTURE, ROADWAY AND TRAIN STATION

(71) Applicant: NINO R. VAGHI FOUNDATION, Kensington, MD (US)

(72) Inventor: Nino R. Vaghi, Kensington, MD (US)

(73) Assignee: The Nino R. Vaghi Foundation Inc., Kensington, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/455,288

(22) Filed: Jun. 27, 2019

Related U.S. Application Data

(63) Continuation of application No. 16/044,458, filed on Jul. 24, 2018, now Pat. No. 10,337,202.

(51) Int. Cl.

| | |
|---|---|
| ***E04H 6/08*** | (2006.01) |
| ***E04H 6/10*** | (2006.01) |
| ***E01C 1/00*** | (2006.01) |
| ***E01C 1/04*** | (2006.01) |

(52) U.S. Cl.
CPC ..... *E04H 6/08* (2013.01); *E01C 1/002* (2013.01); *E01C 1/04* (2013.01); *E04H 6/10* (2013.01)

(58) Field of Classification Search
CPC ... E04H 6/08; E04H 6/10; E01C 1/002; E01C 1/04
See application file for complete search history.

(56) References Cited

U.S. PATENT DOCUMENTS

| | | | | |
|---|---|---|---|---|
| 3,319,385 | A | 5/1967 | Szpytman | |
| 8,915,669 | B1 | 12/2014 | Gustafson et al. | |
| 9,267,306 | B2 | 2/2016 | Suhami | |
| 10,337,202 | B1 * | 7/2019 | Vaghi | E04H 6/08 |
| 2005/0280555 | A1 | 12/2005 | Warner, IV | |
| 2008/0038054 | A1 | 2/2008 | Gustafson | |
| 2016/0340923 | A1 | 11/2016 | Stauffer | |

FOREIGN PATENT DOCUMENTS

| | | | |
|---|---|---|---|
| CN | 102383636 | A | 3/2012 |
| WO | 2010062204 | A1 | 6/2010 |

OTHER PUBLICATIONS

Any identified foreign patents and/or publications have been provided in parent U.S. Appl. No. 16/044,458, filed Jul. 24, 2018, the priority of which is claimed.

* cited by examiner

*Primary Examiner* — Andrew J Triggs
(74) *Attorney, Agent, or Firm* — Richard C. Litman; Nath, Goldberg & Meyer

(57) ABSTRACT

The combination parking structure, roadway and train station is a commuter-based system for relieving traffic congestion. The combination parking structure, roadway and train station includes a parking structure having a plurality of levels, at least one roadway, and a train station within the parking structure. A primary entry ramp branches from the at least one roadway, and a plurality of secondary entry ramps each branch from the primary entry ramp. Each secondary entry ramp connects with, and leads into, a corresponding one of the plurality of levels of the parking structure. Similarly, a primary exit ramp feeds into the at least one roadway, and a plurality of secondary exit ramps each connects with, and leads from, a corresponding one of the plurality of levels of the parking structure and feeds into the primary exit ramp. An internal portion of a set of train tracks is located within the parking structure.

7 Claims, 3 Drawing Sheets

COMBINATION PARKING STRUCTURE, ROADWAY AND TRAIN STATION

CROSS REFERENCE TO RELATED APPLICATIONS

This application is a continuation of Ser. No. 16/044,458, filed Jul. 24, 2018, now pending.

BACKGROUND

1. Field

The disclosure of the present patent application relates to commuter transportation, and particularly to a combination parking structure, roadway and train station.

2. Description of the Related Art

In addition to mere inconvenience for commuters, highway traffic is detrimental in numerous ways. For the individual commuter, congested highways, and their resultant traffic, are costly in terms of both wasted fuel and time. The latter concern may result in lost wages for the commuter. On the societal level, congested highways, and their resultant traffic, have a major negative impact on the environment and, further, the economic issues of the individual commuters result in large scale economic issues for the nation's workforce.

In order to reduce traffic congestion, new roadways are constructed, providing both additional roads and new traffic patterns. However, during construction of the new roadways, which often take years to finish, the problem of traffic congestion becomes even worse. Further, the construction of new roadways typically involves conversion of pre-existing land, often covered with foliage, thus creating a negative environmental impact. Additionally, by providing roadways to accommodate an ever increasing volume of vehicles, the environmental issue of air pollution is not only ignored, but made worse.

Rather than widening existing roadways, or building new roadways and traffic patterns, it would be desirable to decrease the number of vehicles on the road, rather than simply providing ways to accommodate more vehicles. By removing vehicles from the road, rather than providing new routes for greater volumes of traffic, time, money and effort will no longer be required for massive construction projects. Additionally, commuters will be able to spend less money on gas and automobile maintenance, waste less time on the road, and be exposed to much lower levels of air pollution. Additionally, levels of smog, air pollution and noise pollution will decrease, and the quantity and rate of national roadway repairs will also decrease. Thus, a combination parking structure, roadway and train station solving the aforementioned problems is desired.

SUMMARY

The combination parking structure, roadway and train station is a commuter-based system for relieving traffic congestion. The combination parking structure, roadway and train station includes a parking structure having a plurality of levels, at least one roadway, and a train station within the parking structure. A primary entry ramp branches from the at least one roadway, and a plurality of secondary entry ramps each branch from the primary entry ramp. Each secondary entry ramp connects with, and leads into, a corresponding one of the plurality of levels of the parking structure. Similarly, a primary exit ramp feeds into the at least one roadway, and a plurality of secondary exit ramps each connects with, and leads from, a corresponding one of the plurality of levels of the parking structure and feeds into the primary exit ramp. An internal portion of at least one set of train tracks is located within the parking structure and is associated with the train station. At least one external portion of the at least one set of train tracks is connected to the internal portion and extends outwardly from the parking structure.

A lowermost one of the plurality of levels is positioned over a portion of the at least one roadway, such that the at least one roadway passes beneath the parking structure. In this manner, traffic may continue along the at least one roadway unimpeded, as entry to the parking structure is effected by the primary entry ramp, and egress from the parking structure is effected by the primary exit ramp. Additionally, at least one sign may be mounted external to the parking structure. The at least one sign indicates occupancy of at least one of the plurality of levels of the parking structure. A plurality of such signs may be provided for each of the secondary entry ramps, and their corresponding levels of the parking structure. Additionally, a master sign, indicating occupancy for all of the levels, may be provided for the primary entry ramp.

These and other features of the present disclosure will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
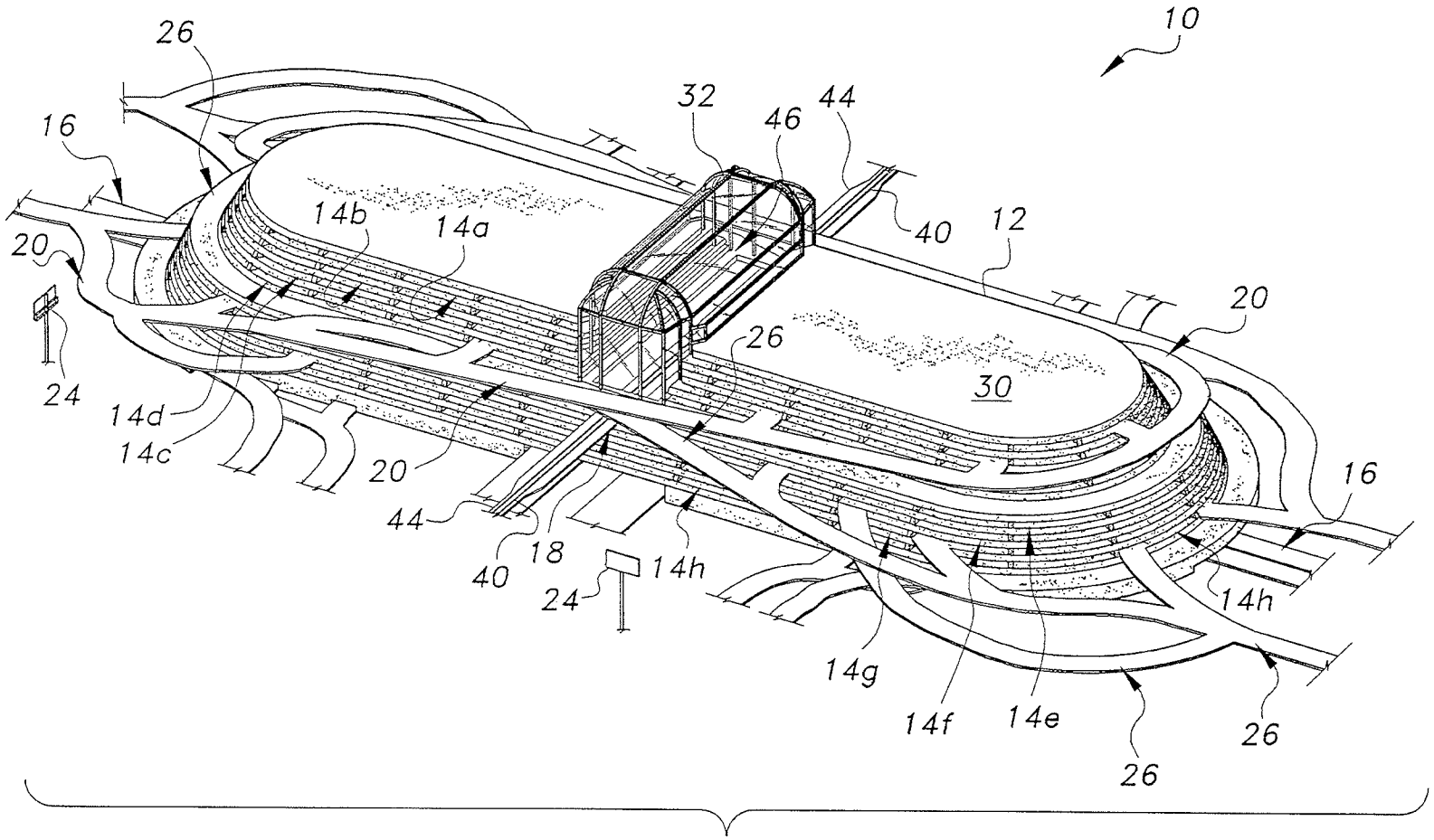
FIG. 1 is a front elevational view of a combination parking structure, roadway and train station.
Figure 2A:
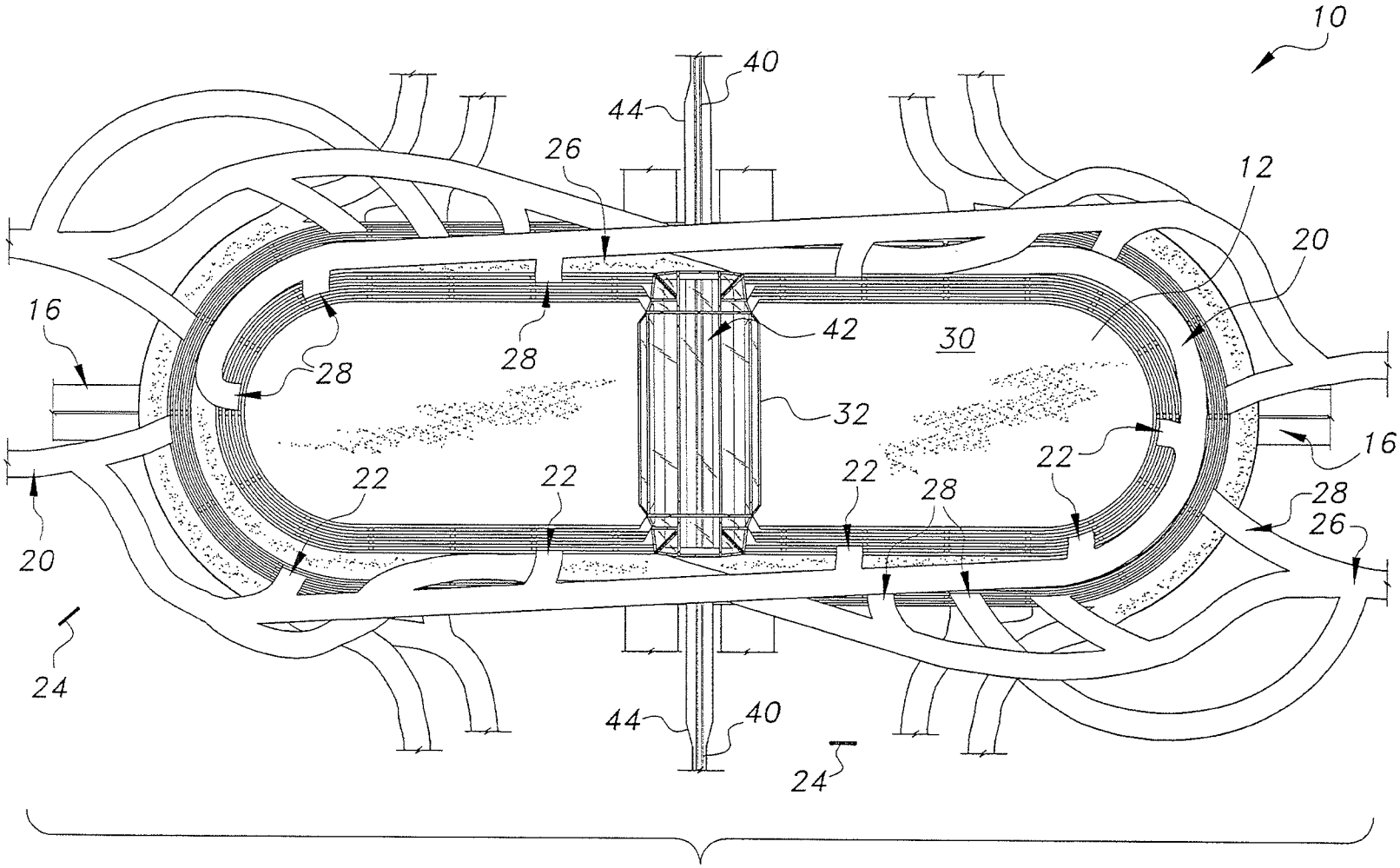
FIG. 2A is a top view of the combination parking structure, roadway and train station.

The combination parking structure, roadway and train station 10 is a commuter-based system for relieving traffic congestion. As shown in FIGS. 1 and 2A, the combination parking structure, roadway and train station 10 includes a parking structure 12 having a plurality of levels 14*a*-14*h*, at least one roadway 16, and a train station 18 within the parking structure 12. The at least one roadway 16 can include multiple lanes. It should be understood that the substantially oval configuration of parking structure 12 shown in FIGS. 1 and 2A is shown for exemplary purposes only, and that parking structure 12 may have any desired overall configuration, shape and relative dimensions. Further, although FIG. 1 shows parking structure having levels 14*a*-14*h*, it should be understood that any desired number of levels may be included in parking structure 12.

As shown, a primary entry ramp 20 branches from the at least one roadway 16. In the exemplary orientation of FIG. 2A, primary entry ramp 20 is shown to the left of parking structure 12. As best seen in FIG. 2A, a plurality of secondary entry ramps 22 each branch from the primary entry ramp 20, and each secondary entry ramp connects with, and leads into, a corresponding one of the plurality of levels 14*a*-14*h* of parking structure 12. As best seen in FIG. 2A, the primary entry ramp 20 wraps or winds around parking structure 12, in a substantially partial spiral path, allowing drivers to access higher levels the farther they travel on primary entry ramp 20.

At least one sign 24 may be mounted external to the parking structure 12. The at least one sign 24 can include indicia indicating the occupancy of at least one of the plurality of levels of the parking structure 12. In FIGS. 1 and 2A, sign 24 is shown positioned adjacent the primary entry ramp 20, in the vicinity of the branching of primary entry ramp 20 from roadway 16, allowing drivers to know the occupancy of each level in advance of traveling about parking structure 12. In this manner, drivers may plan in advance for which of the secondary entry ramps 22 (corresponding to a particular level with vacancies) they intend to take. In the non-limiting example of FIGS. 1 and 2A, sign 24 is shown as a master sign, indicating occupancy for all of the levels. It should be understood that a plurality of such signs may also be provided for each of the secondary entry ramps 22, and their corresponding levels of the parking structure 12, either in addition to a master sign or as a substitute for a master sign. It should be understood that any suitable type of signage may be used, such as that commonly used for changeable highway informational signs.

As shown in FIG. 2A, a primary exit ramp 26 feeds into the at least one roadway 16, and a plurality of secondary exit ramps 28 each connects with, and leads from, a corresponding one of the plurality of levels 14*a*-14*h* of parking structure 12 and feeds into the primary exit ramp 26. Similar to the primary entry ramp 20, the primary exit ramp 26 wraps or winds around parking structure 12, in a substantially partial spiral path.

Figure 2B:
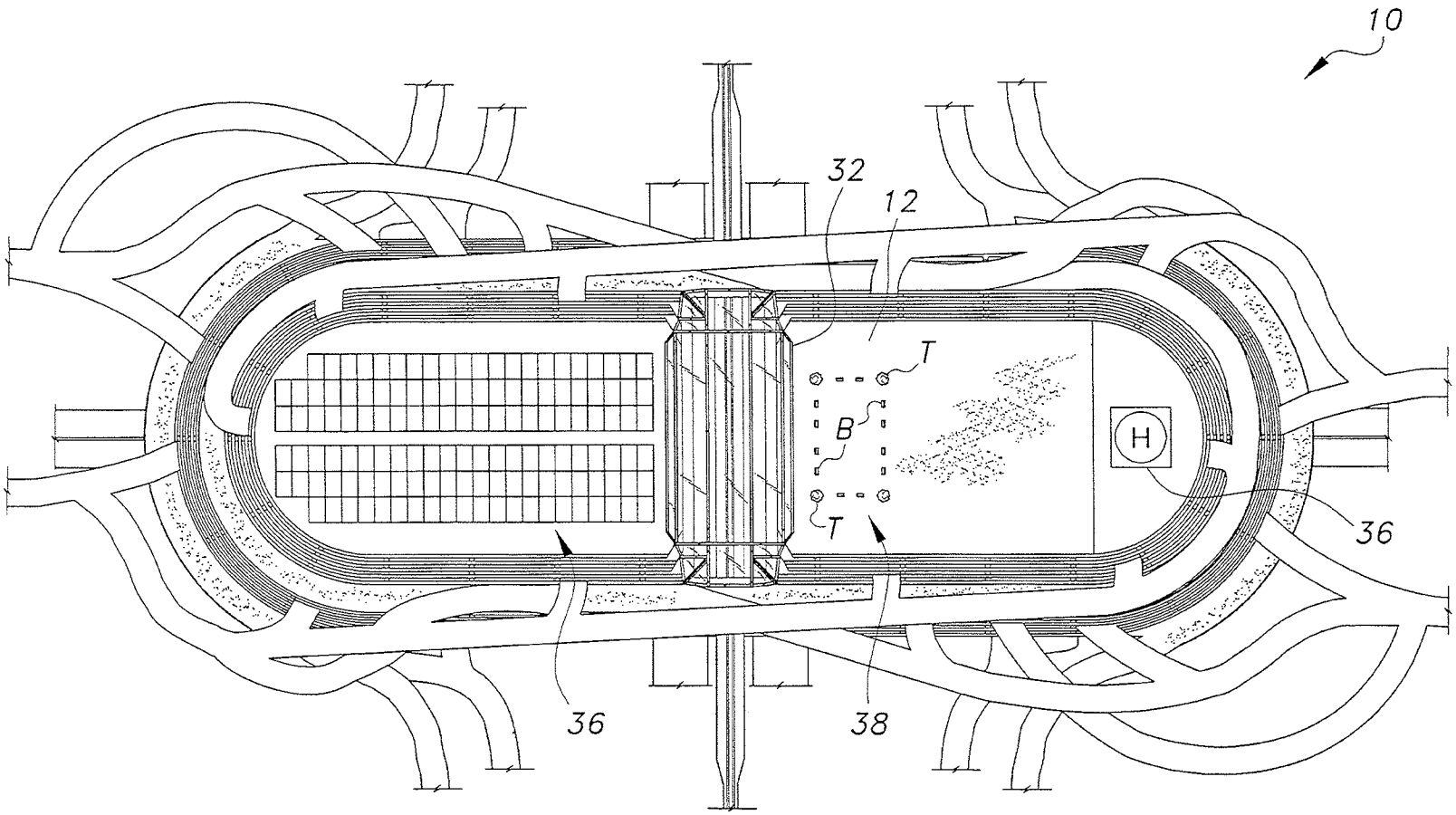
FIG. 2B is a top view of an alternative embodiment of the combination parking structure, roadway and train station.

In FIG. 2A, the roof 30 of parking structure 12 is shown as being bisected by a transparent, decorative covering 32, made from glass or the like. It should be understood that roof 30 may be solid or include any other suitable type of design or functional elements. For example, as shown in FIG. 2B, at least a portion of roof 30 may be covered with solar panels 34, providing power for businesses and utilities housed within parking structure 12. It should be understood that solar panels 34 may be mounted to any suitable portion of parking structure 12. As a further example, FIG. 2B also shows a rooftop recreational area 38, with exemplary trees T and benches B. As an additional example, a helipad 36 may be constructed on roof 30.

Returning to FIG. 2A, an internal portion 42 of at least one set of train tracks 40 can be seen through glass covering 32. Internal portion 42 of train tracks 40 are located within the parking structure 12 and are associated with the train station 18, which may include any suitable features typically associated with a train station, such as a ticket booth, platforms and the like. At least one external portion 44 of the at least one set of train tracks 40 is connected to the internal portion 42 and extends outwardly from the parking structure 12, as shown.

A lowermost one of the plurality of levels (i.e., level 14*h* in the exemplary configuration of FIG. 1) is positioned over a portion of the at least one roadway 16, such that the at least one roadway 16 passes beneath the parking structure 12. As shown in FIG. 1, this allows traffic to continue along the at least one roadway 16 unimpeded, as entry to the parking structure 12 is effected by the primary entry ramp 20, and egress from the parking structure is effected by the primary exit ramp 26. It should be understood that the description of primary entry ramp 20 and primary exit ramp 26, particularly with regard to their direction and orientation with respect to at least one roadway 16, is given above for exemplary and illustrative purposes only; i.e., the present invention is contemplated to be used with any suitable type of roadway without limit to particular direction, orientation, number of lanes or overall configuration of the roadway.

It should be understood that parking within the parking structure 12 may be managed in any desired manner. As a non-limiting example, multiple types of parking may be provided for commuters. For example, one type of parking could be conventional parking garage parking; i.e., a commuter enters the parking structure 12, parks in any open parking space, and then pays either daily or hourly. Another exemplary type of parking would be parking space rental, in which a parking space may be rented for a period of time, such as 30 minutes, an hour, one day, etc. In this type of parking, the commuter may have the option to park in the same parking space each visit. The benefit of this type of parking would be ease in remembering where the commuter parked his or her vehicle. As a further option, this rental scheme could allow the commuter to arrive and leave at any desired time for a flat rental fee.

A third exemplary type of parking is the permanent rental or sale of a specific parking space, allowing the commuter exclusive use of the parking space at any desired time or any desired day. A further option would allow the commuter to sell or sub-let the parking space to another commuter. For the rental and sale types of parking, a further option includes an additional membership fee, allowing the commuter to become a member of a special club associated with the parking structure, similar to airline clubs commonly found in airports.

Returning to FIG. 1, an atrium 46 can be seen through the transparent glass covering 32. With atrium 46 being separated from the parking portion of parking structure 12, any desired additional features may be added to parking structure 12. Such features may include, for example, retail locations, restaurants, restrooms, entertainment and the like. In this exemplary configuration, open atrium 46 is located above train station 18. However, it should be understood that the internal architecture of parking structure 12 may be varied dependent upon the particular needs and desires of the commuters using parking structure 12. Thus, it should be understood that atrium 46 is shown for exemplary purposes only, and that the internal structure of the parking structure 12 may include any desired features, such as the exemplary features described above, but not limited thereto. Overall, it should be understood that any desired design, ornamental or internal architectural features are contemplated in combination with parking structure 12.

It should be understood that the particular configuration and orientation of roadway 16, primary entry ramp 20, secondary entry ramps 22, primary exit ramp 26 and secondary exit ramps 28 are shown for exemplary purposes only, and may be varied dependent upon the particular location of combination parking structure, roadway and train station 10, the nature of roadway 16, etc.

It is to be understood that the combination parking structure, roadway and train station is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

I claim:

1. A parking structure adapted to be located above a roadway, comprising:

the parking structure including a parking garage therein comprising a plurality of parking levels, wherein each of the plurality of parking levels of the parking garage includes entry and exit ramps, the parking structure adapted to allow traffic to continue along the roadway unimpeded, wherein the roadway includes multiple lanes going in opposite directions;

at least one primary entry ramp branching from the roadway in each of the directions, each of the primary entry ramps defining an external continuously ascending roadway circumnavigating the parking structure;

a plurality of exit ramps exiting from each of the external ascending roadways, wherein each of the exit ramps connects with, and leads directly into, a corresponding one of the plurality of parking levels of the parking structure at its corresponding entry ramp;

a primary parking structure exit ramp feeding into the roadway in each of the directions; and a plurality of secondary parking structure exit ramps, wherein each of the secondary parking structure exit ramps connects with, and leads directly from, a corresponding one of the plurality of levels of the parking structure and feeds into the primary parking structure exit ramp at its corresponding exit ramp.

2. The parking structure as recited in claim 1, wherein an uppermost one of the parking levels is covered by a roof.

3. The parking structure as recited in claim 2, further comprising at least one solar panel mounted on the roof.

4. The parking structure as recited in claim 2, further comprising an outdoor recreational area on the roof.

5. The parking structure as recited in claim 2, further comprising a helipad mounted on the roof.

6. The parking structure as recited in claim 1, wherein a lowermost one of the parking levels is positioned over a portion of the roadway.

7. A parking facility, comprising:

a parking structure, the parking structure including a parking garage therein comprising a plurality of parking levels, wherein each of the plurality of parking levels of the parking garage includes entry and exit ramps, the parking structure adapted to be connected to multi-lane and multi-directional roadways, at least one primary entry ramp branching from the roadway in each of the directions, each of the primary entry ramps defining an external continuously ascending roadway circumnavigating the parking structure;

a plurality of exit ramps exiting from each of the external ascending roadways, wherein each of the exit ramps connects with, and leads directly into, a corresponding one of the plurality of parking levels of the parking structure at its corresponding entry ramp;

a primary parking structure exit ramp feeding into the roadway in each of the directions; and a plurality of secondary parking structure exit ramps, wherein each of the secondary parking structure exit ramps connects with, and leads directly from, a corresponding one of the plurality of levels of the parking structure and feeds into the primary parking structure exit ramp at its corresponding exit ramp.

* * * * *